US009809410B2

(12) United States Patent
Huang et al.

(10) Patent No.: US 9,809,410 B2
(45) Date of Patent: Nov. 7, 2017

(54) PAPER PAPER OUTPUTTING MECHANISM

(71) Applicant: Foxlink Image Technology Co., Ltd., New Taipei (TW)

(72) Inventors: Kuan Cheng Huang, New Taipei (TW); Yung Kai Chen, New Taipei (TW)

(73) Assignee: Foxlink Image Technology Co., Ltd., New Taipei (TW)

( * ) Notice: Subject to any disclaimer, the term of this patent is extended or adjusted under 35 U.S.C. 154(b) by 130 days.

(21) Appl. No.: 14/953,247

(22) Filed: Nov. 27, 2015

(65) Prior Publication Data

US 2016/0347571 A1 Dec. 1, 2016

(30) Foreign Application Priority Data

May 26, 2015 (TW) ..... 104208089 U

(51) Int. Cl.
*B65H 31/36* (2006.01)
*B65H 31/02* (2006.01)

(52) U.S. Cl.
CPC ..... *B65H 31/36* (2013.01); *B65H 31/02* (2013.01); *B65H 2405/1122* (2013.01); *B65H 2801/06* (2013.01)

(58) Field of Classification Search
CPC ..... B65H 29/34; B65H 29/38; B65H 29/46; B65H 2404/691; B65H 31/32; B65H 31/36; B65H 31/02; B65H 2405/35; B65H 2405/1122
USPC ..... 271/84, 189, 191
See application file for complete search history.

(56) References Cited

U.S. PATENT DOCUMENTS 3,405,932 A * 10/1968 Dame ..... C14B 1/62 271/84
5,014,974 A * 5/1991 Jones ..... B65H 31/32 271/189
5,110,112 A * 5/1992 Henn ..... B65H 31/32 271/183
8,951,003 B2 * 2/2015 Salovaara ..... B65H 29/34 414/790.8

* cited by examiner

*Primary Examiner* — Michael C McCullough
(74) *Attorney, Agent, or Firm* — WPAT, P.C., Intellectual Property Attorneys; Anthony King

(57) ABSTRACT

A paper outputting mechanism includes a frame, a motor mounted to the frame, a paper supply tray assembly, a gear assembly, a paper pressing element, a blocking element and a plurality of elastic elements. A rear of the frame has a receiving room, a front of the frame has a slope connected with the receiving room. The paper supply tray assembly includes a first paper supply tray slidably mounted to the frame and a second paper supply tray placed on the first paper supply tray. A gear assembly is driven by the motor, the gear assembly drives the first and second paper supply tray to move frontward and rearward. The paper pressing element is up and down movably mounted to the frame and located over the slope. The blocking element is front and down slidably mounted to the frame and in front of the paper pressing element.

10 Claims, 5 Drawing Sheets

PAPER PAPER OUTPUTTING MECHANISM

BACKGROUND OF THE INVENTION

1. Field of the Invention

The present invention relates to a paper outputting mechanism, and more particularly to a paper outputting mechanism capable of arranging outputted papers regularly and stacking the papers steadily.

2. The Related Art

A paper outputting mechanism is provided on electronic devices such as printing mechanisms, copiers, scanners, paper cutters and gluing machines to send papers after being processed. The paper outputting mechanism includes an output tray to place the papers sent by the paper output mechanism. The papers fall on the output tray by gravity.

However, the papers fall on the output tray by their own gravity, then the papers on the output tray are difficult to be regular. Therefore, it is necessary to provide a paper outputting mechanism having a function of making the papers regularly and stacking papers steadily.

SUMMARY OF THE INVENTION

Accordingly, an object of the present invention is to provide a paper outputting mechanism. The paper outputting mechanism includes a frame, at least one motor mounted to the frame, a paper supply tray assembly, a gear assembly, a paper pressing element and a blocking element. A rear of the frame has a receiving room, a front of the frame has a slope connected with the receiving room and inclining downward from a rear to a front of the slope. The paper supply tray assembly includes a first paper supply tray and a second paper supply tray placed on the first paper supply tray. The first and second paper supply trays are placed on the receiving room when the paper outputting mechanism is out of work. Front ends of two sides of the first paper supply tray extend upward to form two first support plates, rear ends of the first support plates forms two first tilting surfaces inclining downward from fronts to rears of the two first tilting surfaces. Front ends of two sides of the second paper supply tray extend upward to form two second support plates, front ends of the second support plates form two second tilting surfaces inclining downward from rears to fronts of the second tilting surfaces. At least one first elastic element is disposed between the first and second paper supply trays. The gear assembly is driven by the motor, the gear assembly drives the first paper supply tray to move frontward and rearward. The paper pressing element is up and down movably mounted to the frame and located over the slope. Two sides of the paper pressing element are connected to the frame by two second elastic elements. The blocking element is front and down slidably mounted to the frame and located over the slope and in front of the paper pressing element. Two sides of the blocking element are connected to the frame by two third elastic elements. The motor drives the gear assembly to bring along the first paper supply tray and the second paper supply tray move to the slope and further move frontward on the slope, the second support plates of the second paper supply tray make the paper pressing element move upward by guide of the second tilting surfaces for allowing pass of a paper, the second paper supply tray pushes the blocking element frontward until the blocking element move to a blocked position, this time, the second supporting plates depart from the paper pressing element, the paper pressing element is supported on the first supporting plates, the paper falls down to make a front end of the paper against the blocking element by its own gravity, then the first paper supply tray continues to move frontward to make the first supporting plates depart from the paper pressing element to make the paper pressing element fall downward to press the paper, then the first and second paper supply trays move rearward and then make the paper pressing element raise upward by guide of the first tilting surfaces.

As described above, the first paper supply tray and the second paper supply tray are driven move to the slope and further move frontward on the slope, the second support plates of the second paper supply tray make the paper pressing element move upward by guide of the second tilting surfaces for allowing pass of a paper, the second paper supply tray pushes the blocking element frontward until the blocking element move to a blocked position, this time, the second supporting plates depart from the paper pressing element, the paper pressing element is supported on the first supporting plates, the paper falls down to make a front end of the paper against the blocking element by its own gravity, then the first paper supply tray continues to move frontward to make the first supporting plates depart from the paper pressing element to make the paper pressing element fall downward to press the paper, then the first and second paper supply trays move rearward and then make the paper pressing element raise upward by guide of the first tilting surfaces for allowing next paper pass under the paper pressing element. Repeat this process to reach the function of arranging the papers regularly and stacking the papers steadily.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
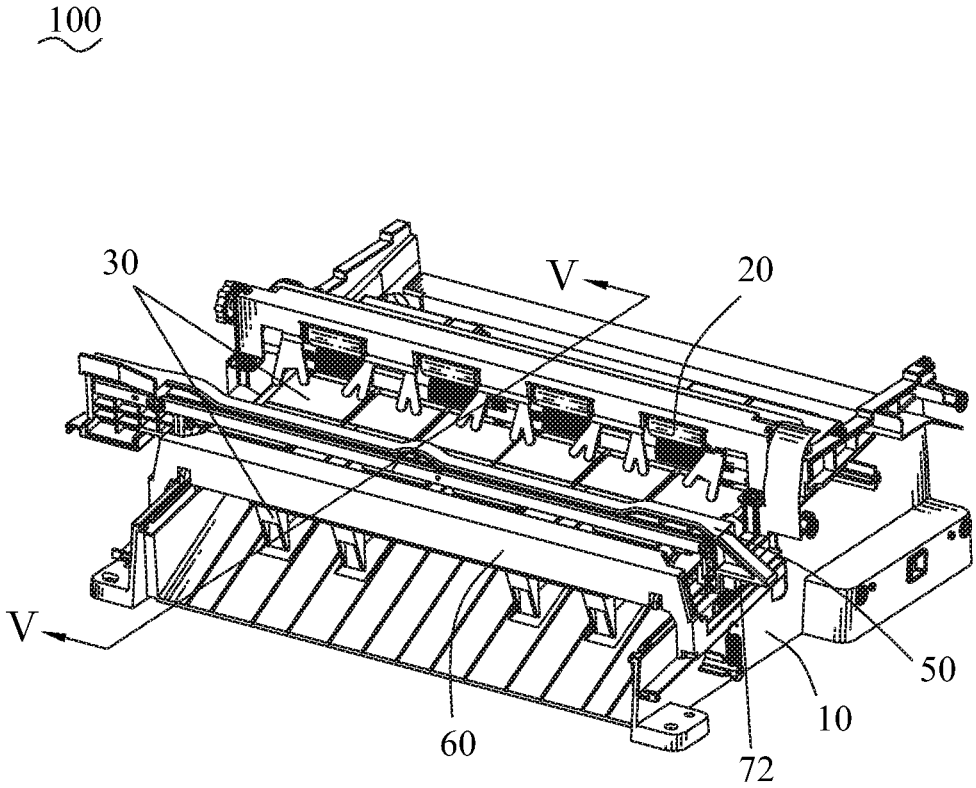
FIG. 1 is an assembled, perspective view of a paper outputting mechanism in accordance with an embodiment of the present invention.

Referring to FIG. 1, FIG. 2, FIG. 3 and FIG. 4, a paper outputting mechanism 100 in accordance with the present invention is shown. The paper outputting mechanism 100 includes a frame 10 as a supporting structure of the paper outputting mechanism 100, a paper output roller group 20 mounted to the frame 10, at least one motor 80, a paper supply tray assembly 30, a gear assembly 40, a paper pressing element 50, a blocking element 60. In this embodiment, the paper pressing element 50 is up and down movably mounted to the frame 10. The blocking element 60 front and down slibably mounted to the frame 10 and in front of the paper pressing element 50.

Referring to FIG. 1, FIG. 2, FIG. 3 and FIG. 4, a rear of an upside of the frame 10 defines a receiving room 11. A front of an upside of the frame 10 defines a slope 12 connected to a front end of the receiving room 11 and extended downward and frontward. The slope 12 defines a plurality of holding grooves 13 extended frontward and rearward and connected to the receiving room 11. The frame 10 has two opposite side walls 14 locating the receiving room 11 and the slope 12 therebetween. Fronts of the two side walls 14 define two guiding grooves 16 extending upward and downward. Outsides of the two side walls 14 define two sliding rails 17 extending frontward and rearward and extending to a front surface of the frame 10. Front ends of the sliding rails 17 form two stopping blocks 18. The outsides of the two side walls 14 define two first fixing blocks 161 located below the corresponding guiding grooves 16. The outsides of the two side walls 14 protrude two second fixing blocks 171 located above the corresponding sliding rails 17.

Referring to FIG. 1, FIG. 2, FIG. 3 and FIG. 4, the paper supply tray assembly 30 includes a first paper supply tray 31 slidably mounted to the frame 10 in a front and rear direction and a second paper supply tray 32 placed on the first paper supply tray 31 and slidable frontward and rearward relative to the first paper supply tray 31.

Front ends of the two sides of the first paper supply tray 31 extend upward to form two first support plates 312, rear ends of the first support plates 312 form two first tilting surfaces 313 inclining downward from fronts to rears of the two first tilting surfaces 313. A front end of the first paper supply tray 31 protrudes downward to form a plurality of support feet 314. The support feet 314 slide in the holding grooves 13. The first paper supply tray 31 defines a plurality of sliding grooves 315 extending frontward and rearward and penetrating the first paper supply tray 31. A bottom of the first paper supply tray 31 protrudes to form a plurality of hook blocks 316 located in front of the respective sliding grooves 315. Two opposite sides of the bottom of the first paper supply tray 31 define two gear tracks 317 extending frontward and rearward. The first paper supply tray 31 further defines a plurality of restraint slots 318 extending frontward and rearward and penetrating the first paper supply tray 31. Front ends of two opposite sides of the second paper supply tray 32 extend upward and frontward to form two second support plates 321. Front ends of the second support plates 321 exceed a front surface of the second paper supply tray 32. Front ends of the second support plates 321 form two second tilting surfaces 322 inclining downward from rears to fronts of the second tilting surfaces 322. A bottom of the second paper supply tray 32 protrudes downward to form a plurality of hook guiding blocks 323. The bottom of the second paper supply tray 32 corresponding to the restraint slots 318 protrudes downward and further bends sideward to form a plurality of L-shaped restraint plates 324. The second paper supply tray 32 is mounted on the first paper supply tray 31. The second support plates 321 are placed inside the corresponding first support plates 312. The hook guiding blocks 323 are disposed in the corresponding sliding grooves 315 and protrude beyond the bottom of the first paper supply tray 31. The hook guiding blocks 323 are capable of moving frontward and rearward within the sliding grooves 315. The restraint plates 324 are held in the restraint slots 318 for preventing the second paper supply tray 32 off from the first paper supply tray 31. The restraint plates 324 are capable of moving frontward and rearward within the restraint slots 318. Therefore, the second paper supply tray 32 can slide frontward and rearward relative to the first paper supply tray 31 and be relatively fixed with the first paper supply tray 31 by the restraint plates 324 in an up and down direction. One end of first elastic elements 70 are hooked to the hook blocks 316 and the other end of the first elastic elements 70 are hooked to the hook guiding blocks 323.

The gear assembly 40 is driven by the motor 80, the gear assembly 40 drives the first paper supply tray 31 to move frontward and rearward. The gear assembly 40 includes a driving gear group 41, a driving shaft 42 connected to the driving gear group 41 and driven by the drive gear group 41 and a driven gear 43. The driving shaft 42 is provided in the receiving room 11 and located below the first paper supply tray 31. The driven gear 43 is mounted on the driving shaft 42 and corresponding to the gear track 317. The motor 80 drives the drive gear group 41 to make the driving shaft 42 and the driven gear 43 rotate, the driven gear 43 engages with the gear track 317, thereby, the drive gear group 41 drives the first paper supply tray 31 to move frontward and rearward.

The paper pressing element 50 is up and down movably mounted to the frame 10 and located over the slope 12. The paper pressing element 50 has a strip-shaped pressing portion 51. Two sides of the pressing portion 51 extend downward to form two extending portions 52. Two sides of a bottom of the pressing portion 51 have two pressure rollers 511 capable of rotating freely. Insides of bottoms of the extending portions 52 protrudes downward to form two guide blocks 521, Outsides of the bottoms of the extending portions 52 has two first hook portions 522. The guide blocks 521 are inserted into the guiding grooves 16 and are capable of sliding up and down. The pressure rollers 511 are capable of moving upward to away from the second paper supply tray 32 or moving downward to press the second paper supply tray 32 with the paper pressing element 50. One end of second elastic elements 71 are hooked to the first fixing blocks 161 and the other end of the second elastic elements 71 are hooked to the first hook portions 522.

Figure 2:
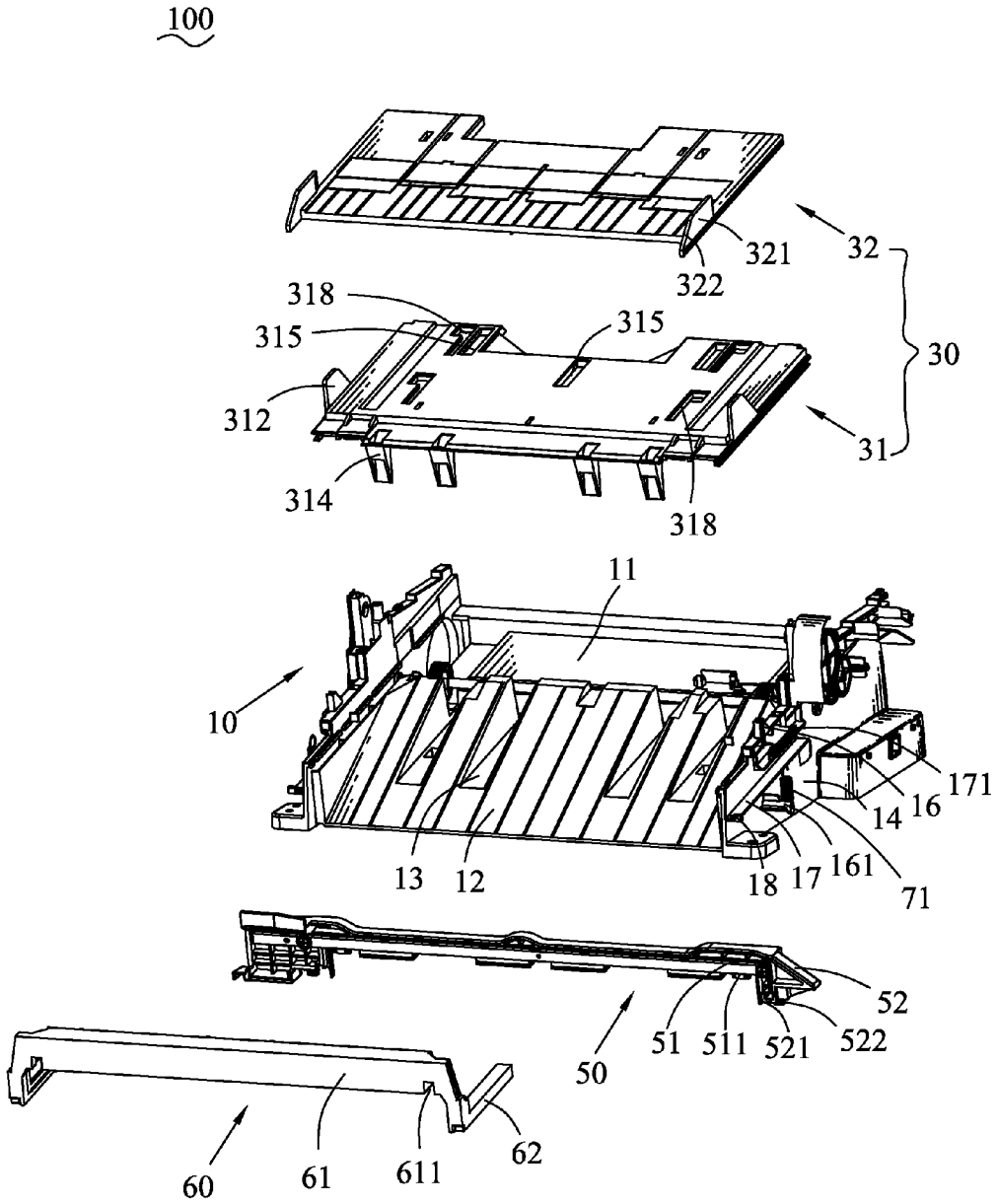
FIG. 2 is a partial exploded, perspective view of the paper outputting mechanism of FIG. 1.
Figure 3:
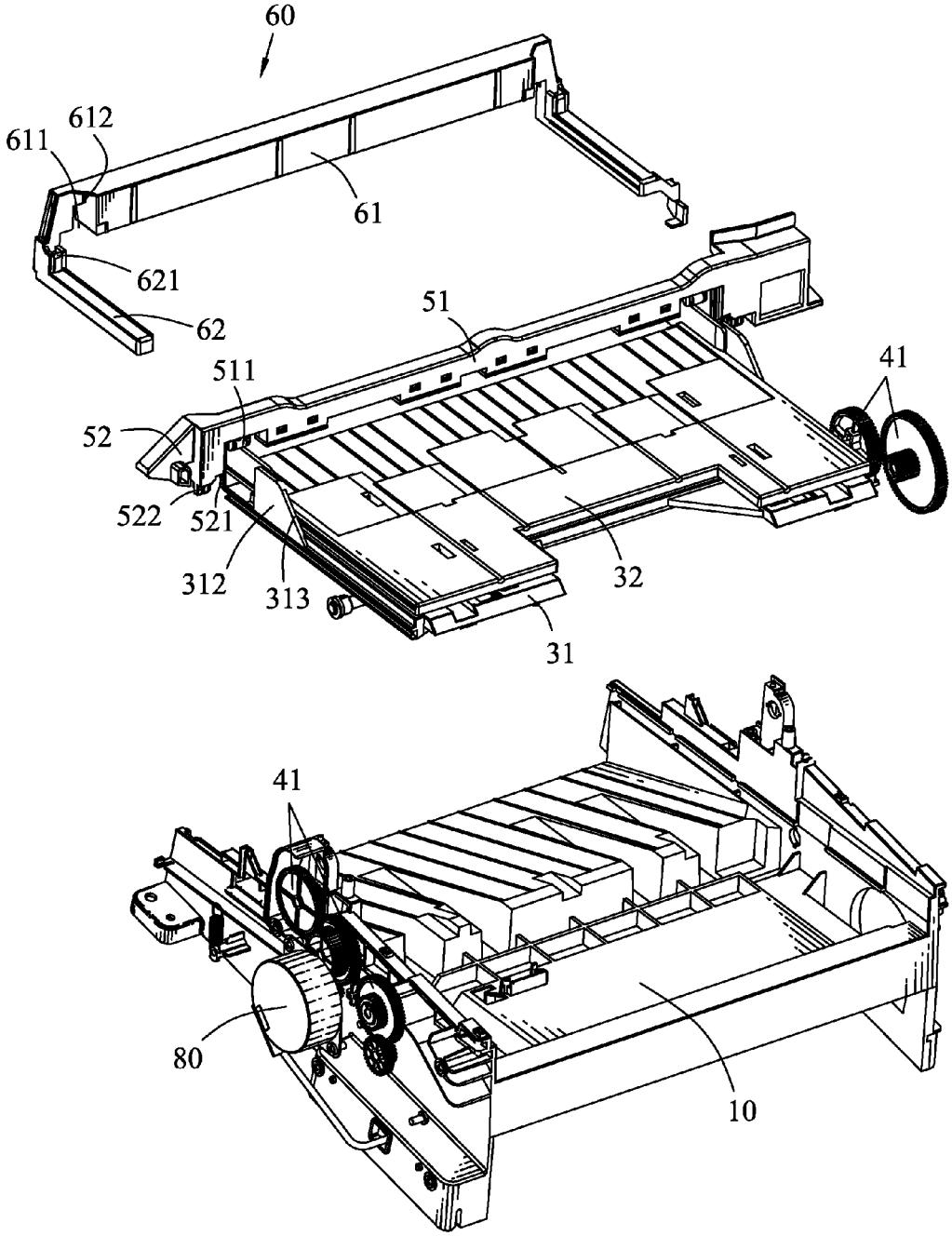
FIG. 3 is another partial exploded, perspective view of the paper outputting mechanism of FIG. 1.
Figure 4:
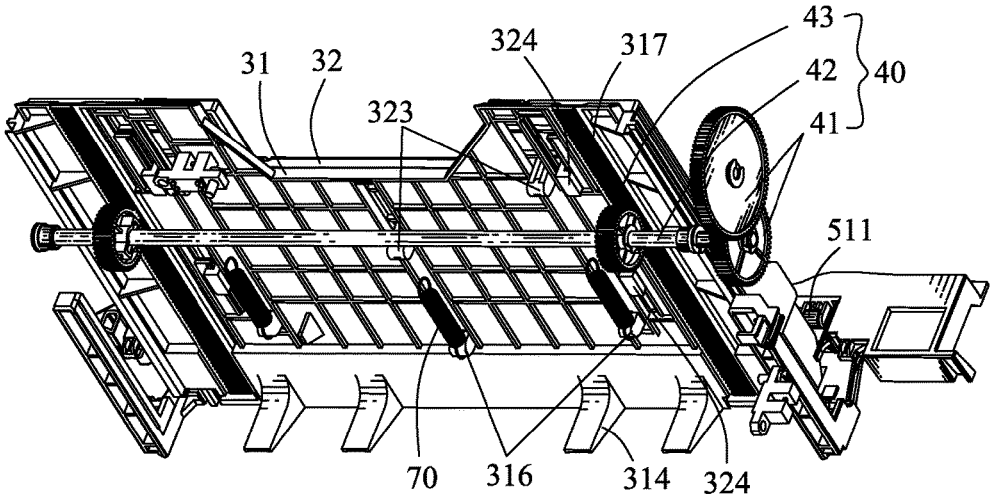
FIG. 4 is another partial perspective view of the paper outputting mechanism of FIG. 1 from another view.
Figure 5:
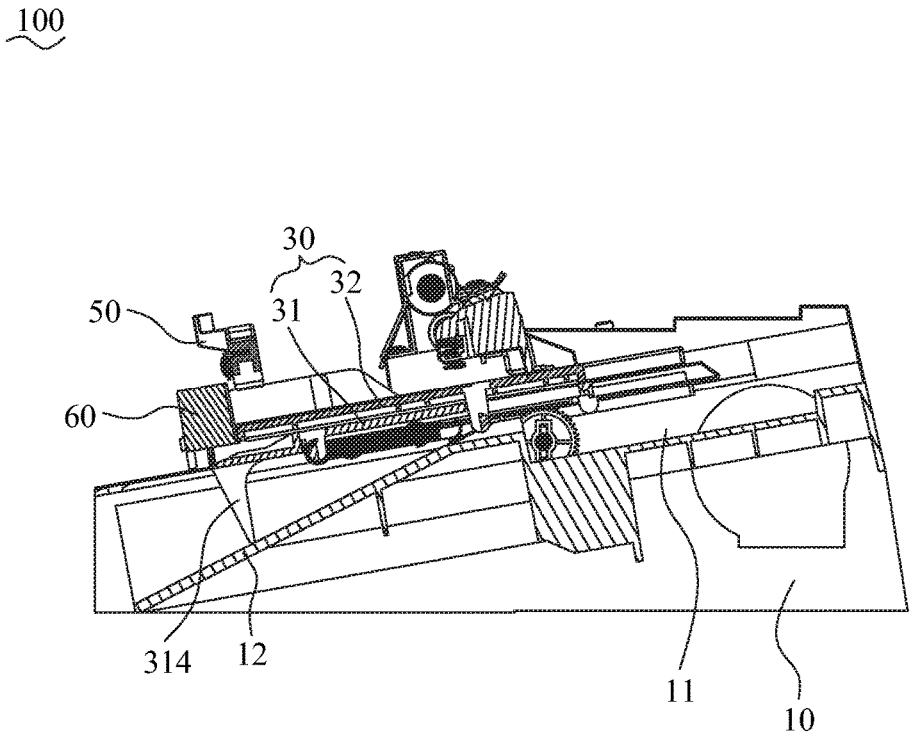
FIG. 5 is a sectional view along the line V-V of FIG. 1 looking in the direction of the arrows.

Referring to FIG. 2 and FIG. 3, the blocking element 60 is front and rear slidably mounted to the frame 10 and located over the slope 12 and in front of the paper pressing element 50. The blocking element 60 has a blocking plate 61, two sides of the blocking plate 61 are extended downward and then further bent rearward to form two substantially L-shaped sliding arms 62. Two sides of a bottom of the blocking plate 61 define two avoiding grooves 611. Top walls of the avoiding grooves 611 form two third tilting surfaces 612 engaging with the second tilting surfaces 322. Front ends of the sliding arms 62 protrude upward to form two second hook portions 621. The blocking element 60 is mounted to the frame 10 and is capable of sliding frontward and rearward by virtue of the sliding arms 62 sliding in the sliding rails 17. One end of the third elastic elements 72 are held in the second fixing blocks 171 and the other end of the third elastic elements 72 are held in the second hook portions 621.

Referring to FIG. 1, FIG. 2, FIG. 3 and FIG. 4, when the paper outputting mechanism 100 is out of work, the first paper supply tray 31 and the second paper supply tray 32 are placed in the receiving room 11 and don't protrude to the slope 12. The paper pressing element 50 is placed on the frame 10. The paper pressing element 50 is not in contact with the paper supply tray assembly 30. The blocking element 60 is placed on rear ends of the sliding rails 17.

Referring to FIG. 1, FIG. 2, FIG. 3 and FIG. 4, when the paper outputting mechanism 100 is at work, the motor 80 rotates clockwise to make the drive gear group 41 rotate so as to drive the driven gear 43. The driven gear 43 rotates to engage with the gear track 317 so as to make the first paper supply tray 31 move frontward. At the same time, the first paper supply tray 31 drives the second paper supply tray 32 move frontward. The first paper supply tray 31 and the second paper supply tray 32 move to the slope 12. Then the second support plates 321 of the second paper supply tray 32 push the pressure rollers 511 to conquer an elastic potential energy of the second elastic elements 71 to make the paper pressing element 50 raise up by the guide of the second tilting surfaces 322. At this time, the paper output roller group 20 sends out the papers to the second paper supply tray 32.

The first paper supply tray 31 and the second paper supply tray 32 continue to move frontward. The second support plates 321 are inserted into the corresponding avoiding grooves 611. The second tilting surfaces 322 push the corresponding third tilting surfaces 612 to make the blocking element 60 slide along the sliding rails 17 until the sliding arms 62 against the corresponding stopping blocks 18. At this time, a front end of the second paper supply tray 32 is against the blocking element 60. The blocking element 60 stops moving. The second supporting plates 321 depart from the paper pressing element 50, the paper pressing element 50 is supported on the first supporting plates 311. The second paper supply tray 32 is on the slope 12 to be at an angle with the gravity direction. The paper completely divorced from the paper output roller group 20 falls down to make a front end of the paper against the blocking element 60 by its own gravity. The paper is fully placed on the second paper supply tray 32.

The first paper supply tray 31 continues to move frontward. The hook guiding blocks 323 relatively slide rearward in the sliding grooves 315. The pressure rollers 511 move downward along the first tilting surfaces 313 until the pressure rollers 511 break away from the first tilting surfaces 313 to press the paper so as to achieve the function of pressing the paper. At the same time, the first paper supply tray 31 keeps motionless. Then, the motor 80 rotates anticlockwise to drive the first paper supply tray 31 move rearward. The first and second paper supply trays 31, 32 move rearward to make the paper pressing element 50 raise upward to depart from the paper by guide of the first tilting surfaces 313. Then, the motor 80 rotates clockwise for waiting for the next paper to enter the paper outputting mechanism 100. Repeating this process, the function of arranging the papers regularly and stacking papers steadily are achieved.

As described above, the first paper supply tray 31 and the second paper supply tray 32 are driven move to the slope 12 and further move frontward on the slope 12, the second support plates 321 of the second paper supply tray 32 make the paper pressing element 50 move upward by guide of the second tilting surfaces 322 for allowing pass of a paper, the second paper supply tray 32 pushes the blocking element 60 frontward until the blocking element 60 move to a blocked position, this time, the second supporting plates 321 depart from the paper pressing element 50, the paper pressing element 50 is supported on the first supporting plates 311, the paper falls down to make a front end of the paper against the blocking element 60 by its own gravity, then the first paper supply tray 31 continues to move frontward to make the first supporting plates 312 depart from the paper pressing element 50 to make the paper pressing element 50 fall downward to press the paper, then the first and second paper supply trays 31, 32 move rearward and then make the paper pressing element 50 raise upward by guide of the first tilting surfaces 313 for allowing next paper pass under the paper pressing element 50. Repeat this process to reach the function of arranging the papers regularly and stacking the papers steadily.

The foregoing description of the present invention has been presented for the purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A paper outputting mechanism, comprising:

a frame, a rear of the frame having a receiving room, a front of the frame having a slope connected with the receiving room and inclining downward from a rear to a front of the slope;

at least one motor mounted to the frame;

a paper supply tray assembly including a first paper supply tray and a second paper supply tray placed on the first paper supply tray, the first and second paper supply trays placed in the receiving room, front ends of two sides of the first paper supply tray extend upward to form two first support plates, rear ends of the first support plates form two first tilting surfaces inclining downward from fronts to rears of the two first tilting surfaces, front ends of two sides of the second paper supply tray extending upward to form two second support plates, front ends of the second support plates form two second tilting surfaces inclining downward from rears to fronts of the second tilting surfaces, at least one first elastic element being disposed between the first and second paper supply trays;

a gear assembly driven by the at least one motor, the gear assembly driving the first paper supply tray to move frontward and rearward;

a paper pressing element up and down movably mounted to the frame and located over the slope, two sides of the paper pressing element being connected to the frame by two second elastic elements; and a blocking element front and rear slidably mounted to the frame and located over the slope and in front of the paper pressing element, two sides of the blocking element being connected to the frame by two third elastic elements;

wherein the at least one motor drives the gear assembly to bring along the first paper supply tray and the second paper supply tray move to the slope and further move frontward on the slope, the second support plates of the second paper supply tray make the paper pressing element move upward by guide of the second tilting surfaces for allowing pass of a paper, the second paper supply tray pushes the blocking element frontward until the blocking element moves to a blocked position, at this time, the second supporting plates depart from the paper pressing element, the paper pressing element is supported on the first supporting plates, the paper falls down to make a front end of the paper against the blocking element by its own gravity, then the first paper supply tray continues to move frontward to make the first supporting plates depart from the paper pressing element to make the paper pressing element fall downward to press the paper, then the first and second paper supply trays move rearward and then make the paper pressing element raise upward by guide of the first tilting surfaces.

2. The paper outputting mechanism as claimed in claim 1, wherein the first paper supply tray defines a plurality of sliding grooves extending frontward and rearward and penetrating the first paper supply tray, a bottom of the first paper supply tray protrudes to form a plurality of hook blocks located in front of the respective sliding grooves, a bottom of the second paper supply tray protrudes downward to form a plurality of hook guiding blocks, the hook guiding blocks are disposed in the corresponding sliding grooves and protrude beyond the bottom of the first paper supply tray, one end of the at least one first elastic element is hooked to the hook blocks and the other end of the at least one first elastic element is hooked to the hook guiding blocks.

3. The paper outputting mechanism as claimed in claim 2, wherein the first paper supply tray further defines a plurality of restraint slots extending front and rear and penetrating the first paper supply tray, the bottom of the second paper supply tray corresponding to the restraint slots protrudes downward and further bends sideward to form a plurality of L-shaped restraint plates, the restraint plates are held in the restraint slots for preventing the second paper supply tray off from the first paper supply tray, the hook guiding blocks are capable of moving frontward and rearward within the sliding grooves, the restraint plates are capable of moving frontward and rearward within the restraint slots.

4. The paper outputting mechanism as claimed in claim 1, wherein two opposite sides of a bottom of the first paper supply tray define two gear tracks extending frontward and rearward, the gear assembly includes a driving gear group, a driving shaft connected to the driving gear group and driven by the drive gear group and a driven gear, the at least one motor drives the drive gear group to make the driving shaft and the driven gear to rotate, the driven gear engages with the gear track.

5. The paper outputting mechanism as claimed in claim 1, wherein the slope defines a plurality of holding grooves extended frontward and rearward and connected to the receiving room, a front end of the first paper supply tray protrudes downward to form a plurality of support feet, the support feet slide in the holding grooves.

6. The paper outputting mechanism as claimed in claim 1, wherein the frame has two side walls locating the receiving room and the slope therebetween.

7. The paper outputting mechanism as claimed in claim 6, wherein fronts of the two side walls define two guiding grooves extending upward and downward, outsides of the two side walls define two first fixing blocks located below the corresponding guiding grooves, the paper pressing element has a strip-shaped pressing portion, two sides of the pressing portion extend downward to form two extending portions, insides of bottoms of the extending portions protrude downward to form two guide blocks, outsides of the bottoms of the extending portions have two first hook portions, the guide blocks are inserted into the corresponding guiding grooves and are capable of sliding up and down, one end of the second elastic element are hooked to the first fixing blocks and the other end of the second elastic element are hooked to the first hook portions.

8. The paper outputting mechanism as claimed in claim 6, wherein outsides of the two side walls define two sliding rails extending frontward and rearward, front ends of the sliding rails form two stopping blocks, outsides of the two side walls protrude two second fixing blocks located above the corresponding sliding rails, the blocking element has a blocking plate, two sides of the blocking plate are extended downward and then further bent rearward to form two substantially L-shaped sliding arms sliding on the sliding rails, two sides of a bottom of the blocking plate define two avoiding grooves, front ends of the second support plates are beyond a front end surface of the second paper supply tray and inserted into the avoiding grooves for pushing the blocking element, front ends of the sliding arms protrude upward to form two second hook portions, one end of the third elastic elements are hooked to the second fixing blocks and the other end of the third elastic elements are held in the second hook portions.

9. The paper outputting mechanism as claimed in claim 8, wherein top walls of the avoiding grooves form two third tilting surfaces engaging with the second tilting surfaces, the second tilting surfaces push the third tilting surfaces to make blocking element slide along the sliding rails until the sliding arms move to the stopping blocks.

10. The paper outputting mechanism as claimed in claim 1, wherein two sides of a bottom of the paper pressing element have two pressure rollers capable of rotating freely, the first tilting surfaces of the first paper supply tray and the second tilting surfaces of the second paper supply tray capable of pushing the pressure rollers to conquer an elastic potential energy of the second elastic elements to make the paper pressing element raise up.

* * * * *